US010063985B2

(12) United States Patent
Audfray et al.

(10) Patent No.: US 10,063,985 B2
(45) Date of Patent: Aug. 28, 2018

(54) GENERATION AND PLAYBACK OF NEAR-FIELD AUDIO CONTENT

(71) Applicant: Dolby Laboratories Licensing Corporation, San Francisco, CA (US)

(72) Inventors: Remi Audfray, San Francisco, CA (US); Nicolas R. Tsingos, San Francisco, CA (US); Jurgen W. Scharpf, San Anselmo, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/573,129

(22) PCT Filed: May 12, 2016

(86) PCT No.: PCT/US2016/032211

§ 371 (c)(1),
(2) Date: Nov. 9, 2017

(87) PCT Pub. No.: WO2016/183379

PCT Pub. Date: Nov. 17, 2016

(65) Prior Publication Data

US 2018/0109895 A1 Apr. 19, 2018

Related U.S. Application Data

(60) Provisional application No. 62/161,645, filed on May 14, 2015.

(30) Foreign Application Priority Data

Oct. 16, 2015 (EP) ..... 15190266

(51) Int. Cl.

| | |
|---|---|
| ***H04S 3/00*** | (2006.01) |
| ***H04R 27/00*** | (2006.01) |
| ***H04S 7/00*** | (2006.01) |

(52) U.S. Cl.
CPC ..... *H04S 3/002* (2013.01); *H04R 27/00* (2013.01); *H04S 7/302* (2013.01); *H04S 2400/13* (2013.01)

(58) Field of Classification Search
None
See application file for complete search history.

(56) References Cited

U.S. PATENT DOCUMENTS

| | | | |
|---|---|---|---|
| 7,995,770 | B1 | 8/2011 | Simon |
| 8,031,891 | B2 | 10/2011 | Ball |

(Continued)

FOREIGN PATENT DOCUMENTS

| | | |
|---|---|---|
| EP | 2191467 | 6/2010 |
| JP | 2005-217492 | 8/2005 |

(Continued)

OTHER PUBLICATIONS

Bofill, P. et al "Underdetermined Blind Source Separation Using Sparse Representations" Signal Processing, vol. 1, No. 11, pp. 2353-2362, Jun. 2001.

(Continued)

*Primary Examiner* — Paul Huber

(57) ABSTRACT

Audio signals (201) are received. The audio signals include left and right surround channels (206). The audio signals are played back using far-field loudspeakers (101-108, 401-406) distributed around a space (111, 409) having a plurality of listener positions (112, 410). The left and right surround channels are played back by a pair of far-field loudspeakers (103, 106, 403, 405) arranged at opposite sides of the space having the plurality of listener positions. An audio component (208) coinciding with or approximating audio content common to the left and right surround channels is obtained. The audio component is played back using at least a pair of near-field transducers (109, 110, 407, 408) arranged at one of the listener positions. Associated systems (100, 400), (Continued)

methods (800) and computer program products are provided. Systems (300), methods (900) and computer program products providing a bitstream (303) comprising the audio signals and the audio component are also provided, as well as a computer-readable medium with data (700) representing such audio content.

26 Claims, 4 Drawing Sheets

(56) References Cited

U.S. PATENT DOCUMENTS

| | | | | |
|---|---|---|---|---|
| 2008/0273723 | A1 | 11/2008 | Hartung | |
| 2009/0154737 | A1 | 6/2009 | Ostler | |
| 2010/0124345 | A1 | 5/2010 | Wiech, III | |
| 2012/0237037 | A1 | 9/2012 | Ninan | |
| 2014/0079241 | A1 | 3/2014 | Chan | |
| 2014/0119581 | A1* | 5/2014 | Tsingos | H04S 3/008 381/300 |
| 2014/0153753 | A1 | 6/2014 | Crockett | |
| 2015/0256933 | A1* | 9/2015 | Vautin | H04R 3/12 381/86 |

FOREIGN PATENT DOCUMENTS

| | | |
|---|---|---|
| WO | 2013/006338 | 1/2013 |
| WO | 2014/182478 | 11/2014 |

OTHER PUBLICATIONS

Gribonval, R. et al "A Survey of Sparse Component Analysis for Blind Source Separation: Principles, Perspectives, and New Challenges" ESANN, Proceedings, Apr. 26-28, 2006, pp. 323-330.

* cited by examiner

GENERATION AND PLAYBACK OF NEAR-FIELD AUDIO CONTENT

CROSS-REFERENCE TO RELATED APPLICATIONS

This application claims priority to the U.S. Provisional Patent Application No. 62/161,645, filed on May 14, 2015 and claims the benefit of the European Patent Application No. 15190266.5, filed on Oct. 16, 2015, both of which are hereby incorporated by reference in their entirety.

TECHNICAL FIELD

Example Embodiments disclosed herein generally relates to audio processing and in particular to generation and playback of near-field audio content.

BACKGROUND

In a movie theatre, audio content associated with a movie is typically played back using a loudspeaker setup including a plurality of loudspeakers distributed along the walls of the room in which the movie is shown. The loudspeaker setup may also include ceiling-mounted loudspeakers and one or more subwoofers. The loudspeaker setup may for example be intended to recreate an original sound field present at the time and place where the current scene of the movie was recorded or to recreate a virtual sound field of a three-dimensional computer-animated scene. As a movie theatre comprises seats located at different positions relative to the loudspeakers, it may be difficult to convey a desired audio experience to each person watching the movie. The perceived audio quality and/or the fidelity of the recreated sound field may therefore be less than optimal for at least some of the seats in the movie theatre.

U.S. Pat. No. 9,107,023 proposes the use of near-field speakers to add depth information that may be missing, incomplete, or imperceptible in far-field sound waves from far-field speakers, and to remove the multichannel cross-talk and reflected sound waves that otherwise may be inherent in a listening space with the far-field speakers alone. The contents of U.S. Pat. No. 9,107,023 are incorporated by reference in its entirety herein. In other words, audio output from near-field speakers located close to a listener's ears is employed to supplement audio output from a regular loudspeaker setup.

It would be advantageous to provide new ways of generating and playing back near-field audio content, for example to improve the fidelity of the sound field provided by the combination of far-field audio content (e.g., played back by far-field loudspeakers) and near-field audio content.

BRIEF DESCRIPTION OF THE DRAWINGS

In what follows, example embodiments will be described with reference to the accompanying drawings, on which.

Figure 1:
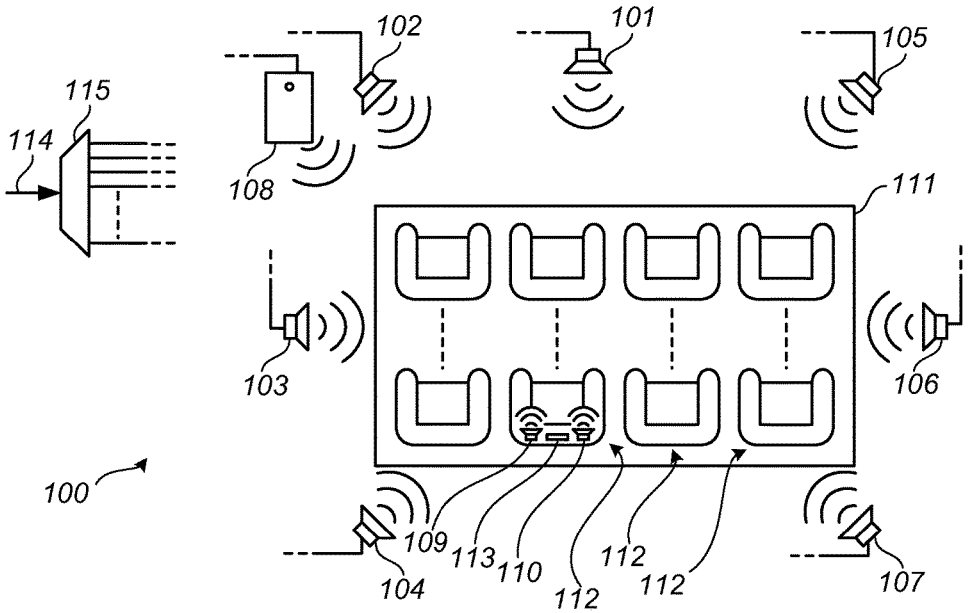
FIG. 1 is a generalized block diagram of an audio playback system, according to an example embodiment.

All the figures are schematic and generally only show parts which are necessary in order to elucidate the example embodiments, whereas other parts may be omitted or merely suggested.

DETAILED DESCRIPTION

As used herein, a channel or audio channel is an audio signal associated with a predefined/fixed spatial position/orientation or an undefined spatial position such as "left" or "right".

As used herein, an audio object or audio object signal is an audio signal associated with a spatial position susceptible of being time-variable, for example, a spatial position whose value may be re-assigned or updated over time.

I. OVERVIEW—PLAYBACK

According to a first aspect, example embodiments propose audio playback methods as well as systems and computer program products. The proposed methods, systems and computer program products, according to the first aspect, may generally share the same features and advantages.

According to example embodiments, there is provided an audio playback method comprising receiving a plurality of audio signals including a left surround channel and a right surround channel, and playing back the audio signals using a plurality of far-field loudspeakers distributed around a space having a plurality of listener positions. The left and right surround channels are played back by a pair of far-field loudspeakers arranged at opposite sides of the space having the plurality of listener positions. The method comprises obtaining an audio component coinciding with or approximating audio content common to the left and right surround channels, and playing back the audio component at least using a pair of near-field transducers arranged at one of the listener positions.

The original sound field that is to be reconstructed may include an audio element or audio source that is located at a point corresponding to a point in the listening space between the pair of loudspeakers at which the left and right surround channels are played back. In the absence of near-field transducers, such an audio element may be panned using the left and right surround channels, so as to create the impression of this audio element being located at a position between the pair of far-field loudspeakers (e.g., at a position near the listener). Therefore, audio content representing such an audio element may be present in both the left and right surround channel, or in other words, such audio content may be common to the left and right surround channels, possibly with differences in amplitude/magnitude and/or phase of the waveform. Using the near-field transducers to play back an audio component coinciding with or approximating such audio content common to the right and left surround channels allows for improving the impression of depth of the reconstructed sound field or proximity of audio elements in the sound field, or in other words, the impression that a particular audio element in the original sound field is closer to the listener than other audio elements in the sound field. The fidelity of the reconstructed sound field as perceived from the listener position, at which the near-field transducers are arranged, may therefore be improved.

It will be appreciated that one or more of the audio signals may for example be processed, rendered, and/or additively mixed (or combined) with one or more audio signals before being supplied to a far-field loudspeaker for playback.

It will also be appreciated that the audio component may for example be processed, rendered, and/or additively mixed (or combined) with one or more audio signals before being supplied to a near-field transducer for playback.

The audio component may for example coincide with audio content common to the left and right surround channel.

The audio component may for example approximate (or be an estimate of) audio content common to the left and right surround channels.

By audio content common to the left and right channels is meant audio content present in the left surround channel which is also present (possibly with a different phase and/or amplitude/magnitude) in the right surround channel.

The pair of near-field transducers may for example be headphones, for example conventional headphones or bone-conduction head phones.

The pair of near-field transducers may for example be left and right near-field loudspeakers arranged on either side of a listener position, for example close to respective intended ear positions, for the near-field audio content not to leak to other listener positions.

The near-field transducers may for example be arranged near or close by the listener position.

The near-field transducers may for example be smaller than the far-field transducers so as to reduce ear occlusion (e.g., to reduce the impact on a listener's ability to hear audio content played back using the far-field loudspeakers).

The audio component may for example be played back at the same level by both near-field transducers.

The audio component may for example be played back using pairs of near-field transducers arranged at the respective listener positions.

The left and right surround channels may for example be the left surround (Ls) and right surround (Rs) channels, respectively, in a 5.1 channel configuration.

The left and right surround channels may for example be the left side surround (Lss) and right side surround (Rss) channels, respectively, in a 7.1 channel configuration.

By the plurality of far-field loudspeakers being distributed around the space having the plurality of listener positions is meant that that the plurality of far-field loudspeakers are located outside the space having the plurality of listener positions (in other words, the far-field loudspeakers do not include loudspeakers arranged within in that space).

The plurality of far-field loudspeakers may for example be distributed along a periphery of the space having the plurality of listening positions.

The plurality of far-field loudspeakers may for example be mounted on or otherwise coupled to the walls around the space having the plurality of listener positions.

The plurality of loudspeakers may for example include loudspeakers arranged above and/or below the space having the plurality of listener positions.

The plurality of loudspeakers may for example include one or more ceiling-mounted loudspeakers.

The plurality of loudspeakers may for example include loudspeakers arranged at different vertical positions (or heights).

The listener positions may for example correspond to seats or chairs where respective listeners are indented to be located.

In some example embodiments, the audio content coinciding with or being approximated by the audio component may for example be maximal in the sense that if this audio content were to be subtracted from the left and right surround channels, respectively, the two channels obtained would be orthogonal and/or uncorrelated to each other.

In example embodiments, the audio component may be obtained by receiving the audio component in addition to the plurality of audio signals. If the audio component is received, there may for example be no need to extract or compute the audio component based on other audio signals.

In example embodiments, the audio component may be obtained by extracting the audio component from the left and right surround channels, or in other words, the method may include the step of extracting the audio component from the left and right surround channels.

The audio component may for example be extracted (or computed) using the method described in EP2191467B1 and referred to therein as "center-channel extraction" (see paragraphs 24-34 for the general method and paragraphs 37-41 for an example implementation). The contents of EP2191467B1 are incorporated herein in its entirety.

The audio component may for example be extracted by at least obtaining an assumed component from a sum of the left surround channel and the right surround channel (e.g., $C_0$=Ls+Rs), calculating a correlation between the left surround channel, less a proportion $\alpha$ of the assumed component, and the right surround channel, less the proportion $\alpha$ of the assumed component (e.g., Correlation(Ls$-\alpha C_0$, Rs$-\alpha C_0$)), obtaining an extraction coefficient from a value of a that minimizes the correlation (e.g., $\alpha_0$=argmin$_\alpha$ Correlation(Ls$-\alpha C_0$, Rs$-\alpha C_0$), and obtaining the extracted audio component by multiplying the assumed component by the extraction coefficient (e.g., $C=\alpha_0 C_0$).

The audio component may for example be extracted (or computed) using other known methods of extracting a common component from two audio signals. Example methods are described in for example the papers "Underdetermined blind source separation using sparse representations" by P. Bofill and M. Zibulevsky, *Signal Processing*, vol. 81, no. 11, pp. 2353-2362, 2001, and "A survey of sparse component analysis for blind source separation: principles, perspectives, and new challenges" by R. Gribonval and S. Lesage, *Proceedings of ESANN,* 2006, the contents which are incorporated herein in its entirety.

The audio component may for example be determined such that if the audio component were to be subtracted from the left and right surround channels, the resulting two channels would be at least approximately orthogonal or uncorrelated to each other.

The audio component may for example be extracted based on analysis across frequency bands of the left and right surround channels.

The audio component may for example be extracted based on analysis of one or more predefined frequency bands of the left and right surround channels.

In example embodiments, the method may further comprise estimating a propagation time from the pair of far-field loudspeakers to the listener position at which the near-field transducers are arranged, and determining, based on the estimated propagation time, a delay to be applied to the playback of the audio component using the near-field transducers.

Individual delays may for example be determined for a plurality of listener positions, so as to adjust the timing of near-field playback (using near-field transducers) relative to far-field playback (using far-field loudspeakers) for the respective listener positions.

In example embodiments, the method may further comprise high pass filtering audio content to be played back using the near-field transducers.

The near-field transducers may be located close to a listener and/or may be structurally coupled to the listener's chair (or in the case of bone-conduction head phones to the listener's body). High pass filtering of the audio content to be played back using the near-field transducers may reduce vibrations generated by low frequency content which may otherwise be distracting to the overall experience.

Further, high pass filtering of the near-field audio content allows for using near-field transducers with limited output capability at low frequencies, for example near-field transducers of a smaller size than the far-field loudspeakers.

In example embodiments, the method may further comprise obtaining dialogue audio content associated with at least one of the received audio signals, and playing back the dialogue audio content using one or more near-field transducers arranged at a listener position.

Near-field playback of dialogue audio content may allow a listener at the corresponding listener position to more easily hear the dialogue (or distinguish the dialogue from other audio content) as compared to a setting in which the dialogue is only played back using far-field loudspeakers.

The one or more near-field transducers employed to play back the dialogue audio content may for example include the pair of near-field transducers.

In some example embodiments, the dialogue audio content may be obtained by receiving the dialogue audio content in addition to the plurality of audio signals. If the dialogue audio content is received, there may for example be no need to extract the dialogue audio content based on other audio signals.

The dialogue audio content may for example be associated with at least one of the plurality of audio signals in the sense that the dialogue audio content may coincide with audio content present also in the at least one of the plurality of audio signals.

In some example embodiments, the dialogue audio content may be obtained by applying a dialogue extraction algorithm to at least one of the received audio signals. Several dialogue extraction algorithms are known in the art.

In some example embodiments, the dialogue audio content may be associated with an audio signal played back by a center far-field loudspeaker. The method may further comprise estimating a propagation time from the center far-field loudspeaker to the listener position at which the one or more near-field transducers are arranged, and determining, based on the estimated propagation time (from the center far-field loudspeaker), a delay to be applied to the playback of the dialogue audio content using the one or more near-field transducers.

Individual delays may for example be determined for a plurality of listener positions, so as to adjust the timing of near-field playback of the dialogue audio content relative to far-field playback of the associated audio signal using the center far-field loudspeaker.

The dialogue audio content may for example be extracted from the audio signal played back by the center far-field loudspeaker, and/or the dialogue audio content may for example coincide with audio content present in the audio signal played back by the center far-field loudspeaker.

In some example embodiments, the method may comprise applying a gain to the dialogue audio content prior to playing it back using the one or more near-field transducers, and subsequently increasing the gain in response to input from a user.

Different listeners may require different dialogue levels/powers in order to hear the dialogue (or to distinguish the dialogue from other audio content), for example due to the particular listener positions relative to the far-field loudspeakers and/or due hearing impairments. The ability to increase the gain applied to the dialogue audio content in response to input from a user allows for obtaining a more appropriate dialogue level for a current listener at a given listener position.

The user input may for example be received via a user input device. The user input device may for example be a portable device such as a mobile phone, watch or tablet computer. The user input device may for example be arranged or mounted at the listener position at which the dialogue audio content is played back by one or more near-field transducers. Furthermore, one or more listening positions of a particular user may be recorded as one or more listening position profiles in memory of the user input device or on a remote server. For example, if a particular user typically sits in a particular row and seat they might find it convenient to recall their particular listening profile for that particular seating position. In addition, one or more suggested listening position profiles might be provided as a suggested listen position profile based on the age, sex, height, and weight of the user.

Individual gains may for example be employed for dialogue audio content played back using near-field transducers arranged at respective listener positions in response to inputs from users at the respective listener positions.

In some example embodiments, the gain may be frequency-dependent. The gain may be increased more for a first frequency range than for a second frequency range, wherein the first frequency range comprises higher frequencies than the second frequency range.

Hearing impairments may be more substantial for higher frequencies than for lower frequencies. An indication by a user that a level/volume of the dialogue is to be increased may be indicative of the user primarily not being able to distinguish high frequency portions of the dialogue audio content. Increasing the gain more for the first frequency range than for the second frequency range may help the user to hear/distinguish the dialogue (or to improve the perceived dialogue timbre), while unnecessary increases of the gain for frequencies in the second frequency range may be reduced or avoided.

In some example embodiments, the method may comprise estimating a power ratio between the dialogue audio content and audio content played back using the far-field loudspeakers or audio content played back using the pair of near-field transducers or a combination of audio content played back using the far-field loudspeakers and audio content played back using the pair of near-field transducers. The method may comprise adjusting, based on the estimated power ratio, a gain applied to the dialogue audio content prior to playing it back using the one or more near-field transducers. Such an adjustment of the gain applied to the dialogue audio content may for example be performed in real-time to maintain the power/volume of the dialogue audio content at a suitable level relative to the power/volume of other audio content played back by near-field transducers and/or audio content played back by the far-field loudspeakers.

In some example embodiments, the received plurality of audio signals may include a channel comprising first dialogue audio content, and this channel may be played back using a far-field loudspeaker. The method may comprise playing back an audio signal using the far-field loudspeaker, capturing the played back audio signal at the listener position at which the one or more near-field transducers are arranged, and adjusting, based on the captured audio signal, an adaptive filter for approximating playback at the far-field loudspeaker as perceived at the listener position at which the one or more near-field transducers are arranged. The method may comprise obtaining the first dialogue audio content by applying a dialogue extraction algorithm to the channel or by receiving the first dialogue audio content in addition to the received plurality of audio signals. The method may comprise applying the adaptive filter to the obtained first dialogue audio content, generating second dialogue audio content based on the filtered first dialogue audio content, and playing back the second dialogue audio content using the one or more near-field transducers for at least partially cancelling, at the listener position at which the one or more near-field transducers are arranged, the first dialogue audio content played back using the far-field loudspeaker.

At least partially cancelling the first dialogue audio content facilitates individualization of the reconstructed sound field at the given listener position. Additional audio content may for example be played back by the near-field transducers to replace the first dialogue audio content.

The played back audio signal may for example be captured using a microphone.

The adaptive filter may for example be an adaptive filter of the type employed for acoustic echo-cancellation, for example a finite impulse response (FIR) filter. The adaptive filter may for example be adjusted so as to approximate a transfer function (or impulse response, or frequency response) corresponding to playback by the far-field loudspeaker as perceived at the listener position at which the one or more near-field transducers are arranged.

In some example embodiments, the method may further comprise playing back third dialogue audio content using the one or more near-field transducers.

The third dialogue audio content may for example include a dialogue in a different language, a voice explaining what is happening in a movie, and/or a voice reading the movie subtitles out loud.

Different third dialogue audio contents may for example be played back individually at the respective listener positions using respective near-field transducers.

In some example embodiments, the method may comprise forming a linear combination of at least the audio component and the dialogue audio content, and playing back the linear combination using the pair of near-field transducers.

The linear combination may for example include further audio content, such as object-based audio content.

In some example embodiments, the method may further comprise receiving an object-based audio signal, rendering the object-based audio signal with respect to one or more of the far-field loudspeakers, playing back the rendered object-based audio signal using the one or more far-field loudspeakers, obtaining a near-field rendered version of the object-based audio signal, and playing back the near-field rendered version of the object-based audio signal using the pair of near-field transducers.

Multiple object-based audio signals may for example be received and rendered. Near-field rendered versions of the object-based audio signals may for example be obtained and played back using the pair of near-field transducers.

In some example embodiments, the near-field rendered version of the object-based audio signal may be obtained by receiving the near-field rendered version of the object-based audio signal.

In some example embodiments, the near-field rendered version of the object-based audio signal may be obtained by rendering the object-based audio signal with respect to the pair of near-field transducers, or in other words, the method may include the step of rendering the object-based audio signal with respect to the pair of near-field transducers.

In some example embodiments, the method may comprise estimating a propagation time from the one or more far-field loudspeakers (in other words, the one or more far-field loudspeakers at which the rendered object-based audio signal is played back) to the listener position at which the pair of near-field transducers is arranged, and determining, based on the estimated propagation time (from the one or more far-field loudspeakers), a delay to be applied to the playback of the near-field rendered version of the object-based audio signal using the pair of near-field transducers.

Individual delays may for example be determined for a plurality of listener positions, so as to adjust the timing of near-field playback relative to far-field playback for the respective listener positions.

In some example embodiments, the method may comprise, for a given listener position playing back a test signal using a far-field loudspeaker and/or a near-field transducer arranged at the listener position, measuring a power level of the played back test signal at the listener position, and calibrating an output level of the near-field transducer relative to an output level of one or more far-field loudspeakers based on the measured power level.

In some example embodiments, the method may comprise, for a given listener position, playing back a test signal using a far-field loudspeaker and/or a near-field transducer arranged at the listener position, capturing the played back test signal at the listener position, and calibrating a frequency response of the near-field transducer relative to a frequency response of one or more far-field loudspeakers based on the captured test signal.

The played back test signal may for example be captured using a microphone.

In some example embodiments, a ratio between a magnitude of the frequency response of the near-field transducer and a magnitude of the frequency response of the one or more far-field loudspeakers may be calibrated to be higher for a first frequency range than for a second frequency range, wherein the first frequency range comprises higher frequencies than the second frequency range. In other words, the magnitude of the frequency response of the near-field transducer may be larger, relative to the magnitude of the frequency response of the one or more far-field loudspeakers, for frequencies in the first frequency range than for frequencies in the second frequency range. Such calibration allows for improving the perceived proximity effect of the audio content played back using the near-field transducers.

In some example embodiments, the method may comprise, in response to a combined power level of audio content played back using the far-field loudspeakers being below a first threshold, amplifying audio content to be played back using the pair of near-field transducers. Additionally or alternatively, the method may comprise, in response to a combined power level of audio content played back using the far-field loudspeakers exceeding a second threshold, attenuating audio content to be played back using the pair of near-field transducers.

If a combined power level of audio content played back by the far-field loudspeakers is below the first threshold, the audio volume may for example be so low that near-field playback at a corresponding level would not be audible. Amplifying audio content to be played back using the pair of near-field transducers may therefore be appropriate when a combined power level of audio content played back by the far-field loudspeakers is below the first threshold.

If a combined power level of audio content played back by the far-field loudspeakers exceeds the second threshold, the audio volume may for example be so loud that near-field playback at a corresponding level would be perceived as too loud and/or would not contribute substantially to the overall perceived audio experience. Attenuating the audio content to be played back using the near-field transducers may therefore be appropriate when a combined power level of audio content played back by the far-field loudspeakers exceeds the second threshold.

In some example embodiments, the method may comprise obtaining, based on at least one of the received audio signals, audio content below a frequency threshold, and feeding the obtained audio content to a vibratory excitation device mechanically coupled to a part of a seat located at the listener position at which the pair of near-field transducers is arranged.

The vibratory excitation device may for example cause vibrations to the seat for reinforcing the impression of an explosion or an approaching thunderstorm represented by the played back audio content.

The audio content below the frequency threshold may for example be received as one of the plurality of audio signals.

The audio content below the frequency threshold may for example be obtained by low-pass filtering one or more of the received audio signals.

According to example embodiments, there is provided a computer program product comprising a computer-readable medium with instructions for causing a computer to perform any of the methods of the first aspect.

According to example embodiments, there is provided an audio playback system comprising a plurality of far-field loudspeakers and a pair of near-field transducers. The plurality of far-field loudspeakers may be distributed around a space having a plurality of listener positions. The plurality of loudspeakers may include a pair of far-field loudspeakers arranged at opposite sides of the space having the plurality of listener positions. The pair of near-field transducers may be arranged at one of the listener positions.

The audio playback system may be configured to receive a plurality of audio signals including a left surround channel and a right surround channel, and play back the audio signals using the far-field loudspeakers. The left and right surround channels may be played back using the pair of far-field loudspeakers. The audio playback system may be configured to obtain an audio component coinciding with or approximating audio content common to the left and right surround channels, and play back the audio component using the near-field transducers.

The audio playback system may for example comprise multiple pairs of near-field transducers arranged at respective listener positions and the audio component may be played back using these pairs of near-field transducers.

The audio playback system may for example comprise an audio processing system configured to extract the audio component from the left and right surround channels.

The audio processing system may for example be configured to process audio content to be played back using the near-field transducers and/or the far-field transducers. The audio processing system may for example be configured to determine a delay to be applied to the playback of the audio component using the near-field transducers, high pass filtering audio content to be played back using the near-field transducers, obtain dialogue audio content by applying a dialogue extraction algorithm to at least one of the received audio signals, determine a delay to be applied to the near-field playback of the dialogue audio content, render an object-based audio signal with respect to one or more of the far-field loudspeakers, render the object-based audio signal with respect to the pair of near-field transducers, and/or determine a delay to be applied to the playback of the near-field rendered object-based audio.

The audio processing system may for example comprise a distributed infrastructure with standalone deployment of computing resources (or processing sections) at the respective listener positions.

The audio processing system may for example be a centralized system, for example arranged as a single processing device.

II. OVERVIEW—PROCESSING METHODS AND SYSTEMS

According to a second aspect, example embodiments propose audio processing methods as well as systems and computer program products. The proposed methods, systems and computer program products, according to the second aspect, may generally share the same features and advantages. The proposed methods, systems and computer program products, according to the second aspect, may be adapted for cooperation with the methods, systems and/or computer program products of the first aspect, and may therefore have features and advantages corresponding to those discussed in connection with the methods, systems and/or computer program products of the first aspect. For brevity, that discussion will not be repeated in this section.

According to example embodiments, there is provided an audio processing method comprising receiving a plurality of audio signals including a left surround channel and a right surround channel, extracting an audio component coinciding with or approximating audio content common to the left and right surround channels, and providing a bitstream. The bitstream comprises the plurality of audio signals and at least one additional audio channel comprising the audio component.

As described above with respect to the first aspect, audio content common to the left and right surround channels may correspond to an audio element which has been panned using the left and right surround channels, and such common audio content may preferably be played back using one or more near-field transducers so as to improve an impression of depth of a sound field reconstructed via playback of the plurality of audio signals or an impression of proximity of an audio source within the reconstructed sound field. The additional audio channel (which is included in the bitstream together with the plurality of audio signals) allows for playback of the extracted audio component using one or more near-field transducers, so as to supplement playback of the plurality of audio signals using a plurality of far-field loudspeakers, and thereby allows for improving the fidelity of the reconstructed sound field as perceived from the listener position, at which the near-field transducers are arranged.

Providing the additional audio channel in the same bitstream as the received audio signals ensures that the additional audio channel accompanies the received audio signals and allows for at least approximately synchronized delivery and playback of the received audio signals and the additional audio channel.

The audio signals may for example be adapted for playback using a plurality of far-field loudspeakers distributed around a space having a plurality of listener positions, or in other words, loudspeakers located outside the space having the plurality of listener positions (in other words, the far-field loudspeakers do not include loudspeakers arranged within in that space).

The plurality of far-field loudspeakers may for example be distributed along a periphery of the space having the plurality of listening positions.

The left and right surround channels may for example be adapted for playback by a pair of far-field loudspeakers arranged at opposite sides of the space having the plurality of listener positions.

The audio component may for example be adapted for playback at least using a pair of near-field transducers arranged at one of the listener positions.

The audio component may for example be extracted from the left and right surround channels using any of the extraction methods described above for the first aspect, for example the method described in EP219146761. The contents of EP2191467B1 are incorporated herein in its entirety.

The at least one additional audio channel may for example include two audio channels, each comprising the audio component. The two audio channels may for example be adapted for playback using respective near-field transducers of a pair of near-field transducers arranged at a listener position.

In some example embodiments, the method may further comprise obtaining dialogue audio content by applying a dialogue extraction algorithm to one or more of the received audio signals, and including at least one dialogue channel in the bitstream in addition to the plurality of audio signals, wherein the at least one dialogue channel comprises the dialogue audio content.

In some example embodiments, the method may further comprise receiving an object-based audio signal, rendering at least the object-based audio signal as two audio channels for playback at two transducers, and including the object-based audio signal and the two rendered audio channels in the bitstream.

The audio component extracted from the first and second surround channels may for example be included in the rendering operation, or in other words, the extracted audio component and the object-based audio signal may be rendered as the two audio channels for playback at two transducers.

The two rendered audio channels may for example be additively mixed with the audio component extracted from the first and second surround channels before being included in the bitstream.

The rendering of at least the object-based audio signal may for example be performed with respect to two near-field transducers.

According to example embodiments, there is provided a computer program product comprising a computer-readable medium with instructions for causing a computer to perform any of the methods of the second aspect.

According to example embodiments, there is provided an audio processing system comprising a processing stage and an output stage. The processing stage may be configured to receive a plurality of audio signals including a left surround channel and a right surround channel, and to extract an audio component coinciding with or approximating a component common to the left and right surround channels. The output stage may be configured to output a bitstream. The bitstream may comprise the plurality of audio signals and at least one additional audio channel comprising the common component.

The audio processing system may for example comprise a receiving section configured to receive a bitstream in which the plurality of audio signals has been encoded.

III. OVERVIEW—DATA FORMAT

According to a third aspect, example embodiments propose a computer-readable medium. The computer-readable medium may for example have features and advantages corresponding to the features and advantages described above for the bitstream provided by the audio processing systems, methods, and/or computer program products, according to the second aspect.

According to example embodiments, there is provided a computer-readable medium with data representing a plurality of audio signals and at least one additional audio channel. The plurality of audio signals includes a left surround channel and a right surround channel. The at least one additional audio channel comprises an audio component coinciding with or approximating audio content common to the left and right surround channels. The data enables joint playback by a plurality of far-field loudspeakers and at least a pair of near-field transducers, wherein a sound field is reconstructed by way of the playback.

As described above with respect to the second aspect, audio content common to the left and right surround channels may correspond to an audio element which has been panned using the left and right surround channels, and such common audio content may preferably be played back using near-field transducers so as to improve the impression of depth of a sound field reconstructed via playback of the plurality of audio signals or an impression of proximity of an audio source within the reconstructed sound field. The additional audio channel allows for playback of the audio component using near-field transducers, so as to supplement playback of the plurality of audio signals using a plurality of far-field loudspeakers, and thereby allows for improving the fidelity of the reconstructed sound field as perceived from a listener position, at which the near-field transducers are arranged.

The computer-readable medium may for example be non-transitory. The computer-readable medium may for example store the data.

The data of the computer-readable medium may for example comprise at least one dialogue channel in addition to the plurality of audio signals.

The data of the computer-readable medium may for example comprise an object-based audio signal and two audio channels corresponding to rendered versions of at least the object-based audio signal. At least one of the two audio channels may for example comprise the audio component coinciding with or approximating audio content common to the left and right surround channels.

The data of the computer-readable medium may for example comprise control information indicating parts/portions of the data intended for far-field playback (e.g., using far-field loudspeakers) and parts/portions of the data intended for near-field playback (e.g., using near-field transducers).

The control information may for example be implicit, or in other words, parts/portions of the data intended for near-field playback and for far-field playback, respectively, may be implicitly indicated, for example via their positions relative to other parts/portions of the data. The respective parts/portions may for example be implicitly indicated via the order in which they are stored or conveyed by the computer-readable medium.

The control information may for example be explicit, or in other words, it may include metadata (e.g., dedicated bits of a bitstream) indicating parts/portions of the data intended for near-field playback, and parts intended for far-field playback.

IV. EXAMPLE EMBODIMENTS

FIG. 1 is a generalized block diagram of an audio playback system 100, according to an example embodiment. The audio processing system 100 comprises a plurality of far-field loudspeakers 101-108 and a pair of near-field transducers 109-110. The far-field loudspeakers 101-108 are distributed around a space 111 having a plurality of listener positions 112, or in other words, the far-field loudspeakers 101-108 are located outside the space 111. The plurality of far-field loudspeakers 101-108 includes a pair of far-field loudspeakers 103 and 106 arranged at opposite sides of the space 111 having the plurality of listener positions 112, or in other words, the space 111 is located between the pair of far-field loudspeakers 103 and 106. The near-field transducers 109-110 are arranged at one of the listener positions 112.

The plurality of far-field loudspeakers 101-108 is exemplified herein by a 7.1 speaker setup including center 101 (C), left front 102 (Lf), left side surround 103 (Lss), left back 104 (Lb), right front 105 (Rf), right side surround 106 (Rss), and right back 107 (Rb) loudspeakers. The speaker setup also includes a subwoofer 108 for playing back low frequency effects (LFE). In some example settings, such as in movie theaters, the single Lss loudspeaker 103 may for example be replaced by an array of loudspeakers for playing back left side surround. Similarly, the single Rss loudspeaker 106 may for example be replaced by an array of loudspeakers for playing back right side surround.

The near-field transducers 109-110 are exemplified herein by near-field loudspeakers arranged at a listener position 112, in close proximity to respective indented ear positions of a listener. The near-field transducers 109-110 may for example be mounted in a seat in a movie theatre. Other examples of near-field transducers 109-110 may be conventional headphones or bone-conduction head phones. Similar near-field transducers may for example be arranged at each of the listener positions 112.

In the present example embodiment, a vibratory excitation device 113 is mechanically coupled to a part of a seat located at the listener position 112 at which the pair of near-field transducers 109-110 is arranged.

Figure 2:
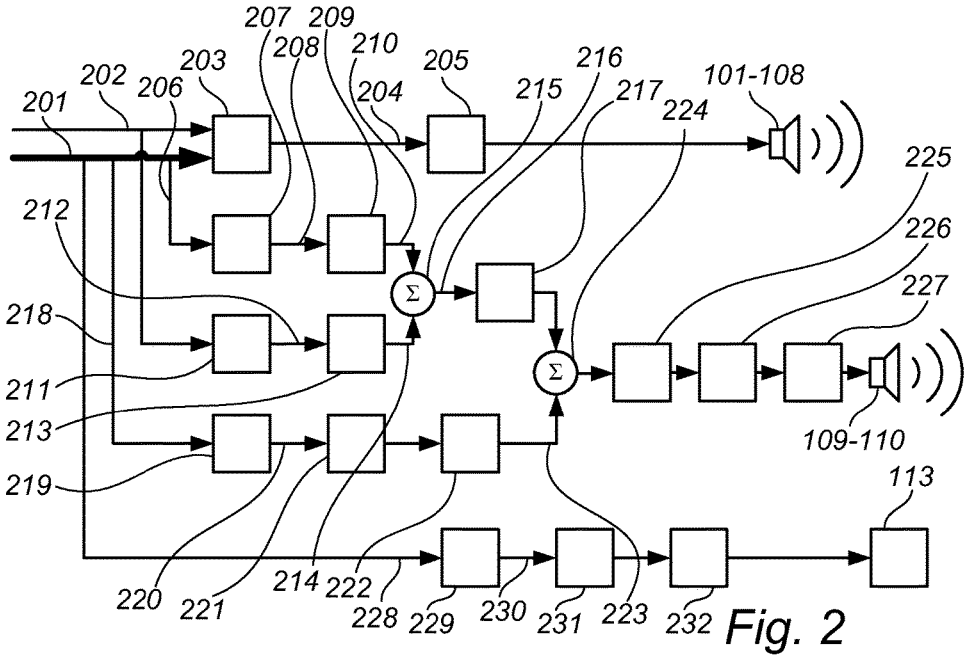
FIG. 2 shows an overview of processing steps that may be performed to provide audio content for near-field playback, according to example embodiments.

FIG. 2 provides an overview of processing steps that may be performed for providing near-field audio content to be played back using the near-field transducers 109-110 and far-field audio content to be played back using the far-field loudspeakers 101-108.

Theatrical audio content generally comprises channel-based audio content 201, for example in a 7.1 channel format suitable for playback using the 7.1 speaker setup 101-108, described with reference to FIG. 1. In more recent formats, such as Dolby Atmos™, such channels 201 (also referred to as bed channels) are supplemented by object-based audio content 202.

The objects 202 are rendered 203 with respect to at least some of the far-field loudspeakers 101-108. If the number of channels 201 in the channel-based audio content 201 matches the number of far-field loudspeakers 101-108, the channels 201 may for example be added to the respective channels obtained when rendering 203 the object-based audio content 202. Alternatively, the channel-based audio content 201 may be included as part of the rendering operation 203.

The channel-based audio content 201 and the rendered object based audio content together form far-field audio content 204 for playback using the far-field loudspeakers 101-108. The far-field audio content 204 is subjected to B-chain processing 205 before being supplied to the far-field loudspeakers 101-108 for playback.

The channel-based audio content 201 includes left and right surround channels 206 intended to be played back using the pair of far-field loudspeakers 103 and 106 arranged at opposite sides of the space 111. An audio component 208 coinciding with or approximating audio content common to the left and right surround channels 206 is extracted 207 from the left and right surround channels 206.

As described above, the audio component 208 may for example be extracted (or computed) using the method described in EP2191467B1 and referred to therein as "center-channel extraction" (see paragraphs 24-34 for the general method and paragraphs 37-41 for an example application), or using other known methods of extracting a common component from two audio signals. The contents of EP2191467B1 are incorporated herein in its entirety. Example methods are described in for example "Underdetermined blind source separation using sparse representations" by P. Bofill and M. Zibulevsky, *Signal Processing*, vol. 81, no. 11, pp. 2353-2362, 2001, and "A survey of sparse component analysis for blind source separation: principles, perspectives, and new challenges" by R. Gribonval and S. Lesage, *Proceedings of ESANN,* 2006. The contents of Gribonval, et al are incorporated herein in its entirety.

The audio component 208 may for example be determined such that if the audio component 208 were to be subtracted from the left and right surround channels 206, the resulting two channels would be at least approximately orthogonal or uncorrelated to each other.

A gain 209 is applied to the extracted audio component 208 to control its relative contribution to the near-field audio content played back by the near-field transducers 109-110. A weighted version 210 of the extracted audio component 208 is thereby obtained.

As the extracted audio component 208 is to be played back using the two near-field transducers 109-110, the extracted audio component 208 may be provided as two channels (e.g., with the same audio content), or in other words, one for each of the near-field transducers 109-110. The two channels may for example be attenuated by 3 dB to compensate for this duplication of the extracted component 208.

The object-based audio content 202 is rendered 211 with respect to the near-field transducers 109-110. A gain 213 is applied to the near-field rendered version 212 of the object-based audio content 202 to control its relative contribution to the near-field audio content played back by the near-field transducers 109-110. A weighted version 214 of the near-field rendered object-based audio content 212 is thereby obtained.

Near-field rendering 211 of the object-based audio content 202 may be performed in a number of different ways. For example, the object-based audio content 202 may be rendered with respect to a predefined virtual configuration of two of more speaker positions. As long as two of the virtual speaker positions correspond to positions within the space 111 (e.g., close the center of the space 111) rather than positions outside the space 111, the corresponding two rendered channels may be suitable for playback using the near-field transducers 109-110. Any remaining rendered channels may for example be disregarded.

Alternatively, the following explicit rendering scheme may be employed for near-field rendering 211 of the object-based audio content 202. The x, y and z coordinates of the audio objects 202 may be employed to compute weights for the respective objects 202 when forming two channels for the respective near-field transducers 109-110. The following example amplitude panning scheme may be employed $$\alpha_{LX} = \begin{cases} \cos\left[(X-(0.5-D/2))\cdot\frac{\pi}{2D}\right] \text{ for } X\epsilon[0.5-D/2;\,0.5+D/2] \\ \cos\left[(X-(0.5-D/2))\cdot\frac{\pi}{(0.5-D)}\right] \text{ for } X\epsilon[0.25;\,0.5-D/2] \\ 0 \text{ for } X<0.25 \text{ or } X>0.5+D/2 \end{cases}$$

$$\alpha_{RX} = \begin{cases} \cos\left[(X-(0.5+D/2))\cdot\frac{\pi}{2D}\right] \text{ for } X\epsilon[0.5-D/2;\,0.5+D/2] \\ \cos\left[(X-(0.5+D/2))\cdot\frac{\pi}{(0.5-D)}\right] \text{ for } X\epsilon[0.5+D/2;\,0.75] \\ 0 \text{ for } X<0.5-D/2 \text{ or } X>0.75 \end{cases}$$

$$\alpha_{Y} = \begin{cases} \cos[(Y-0.5)\cdot 2\pi] \text{ for } Y\epsilon[0.25;\,0.75] \\ 0 \text{ for } Y<0.25 \text{ or } Y>0.75 \end{cases}$$

$$\alpha_{Z} = \begin{cases} \cos[Z\cdot\pi] \text{ for } Z\epsilon[0;\,0.5] \\ 0 \text{ for } Z>0.5 \\ 1 \text{ for } Z<0 \end{cases}$$

$$\alpha_L = \alpha_{LX}\cdot\alpha_Y\cdot\alpha_Z$$

$$\alpha_R = \alpha_{RX}\cdot\alpha_Y\cdot\alpha_Z$$

where

X is the Dolby Atmos™ X coordinate of the object,

Y is the Dolby Atmos™ Y coordinate of the object,

Z is the Dolby Atmos™ Z coordinate of the object, $\alpha_L$ is the weight employed for the object when forming the left near-field channel, $\alpha_R$ is the weight employed for the object when forming the right near-field channel, and D is the spacing between the two near-field transducers 109-110 in the X-direction, normalized with respect to the width of the room (that is, the distance between the far-field speakers 103 arranged at the left hand side of the room and the far-field speakers 106 arranged at the right hand side of the room).

The same near-field rendering 211 may be employed for all the listener positions 112. Alternatively, the near-field rendering 211 may be configured individually for the respective listener positions 112, for example via individual parameter settings for the respective listener positions 112.

The weighted version 210 of the extracted audio component 208 and the weighted version 214 of the near-field rendered object based audio content 212 may be combined (e.g., additively mixed) by a first summing section 215. The first summing section 215 may for example provide two channels, one channel for each of the near-field transducers 109-110, for example by separately combining (or additively mixing) audio content intended for the respective near-field transducers 109-110.

As the near-field audio content is to be played back using the near-field transducers 109-110, which are closer to the listener than the pair of far-field loudspeakers 103 and 106 playing back the left and right surround channels 206, a delay 217 is applied to the output 216 of the first summing section 215 to compensate for the time it takes for sound waves to propagate from the pair of far-field loudspeakers 103 and 106 to the listener position 112 at which the near-field transducers 109-110 are arranged. Individual delays 217 may be determined and employed for near-field playback at the respective listener positions 112.

The channel-based audio content 201 includes a center channel 218 which includes the dialogue of a movie to be played back in a movie theatre where the audio processing system 100, described with reference to FIG. 1, is arranged. A dialogue extraction algorithm 219 may be applied to the center channel 218 to obtain dialogue audio content 220 representing the dialogue.

Alternatively, the dialogue audio content 220 may be received as dedicated dialogue channel, for example only comprising the dialogue audio content 220, and there may be no need to apply a dialogue extraction algorithm to obtain the dialogue audio content 220.

A gain 221 is applied to the dialogue audio content 220 to control its relative contribution to the near-field audio content played back by the near-field transducers 109-110.

As the dialogue audio content 220 is to be played back using the near-field transducers 109-110, which are closer the listener than the far-field center loudspeaker 101 playing back the center channel 218, a delay 222 is applied to the dialogue audio content 220 (e.g., after applying the gain 221) to compensate for the time it takes for sound waves to propagate from the far-field center loudspeaker 101 to the listener position 112 at which the near-field transducers 109-110 are arranged. A delayed version 223 of the dialogue audio content 220 is thereby obtained. Individual delays 222 may be determined and employed for near-field playback at the respective listener positions 112.

As the dialogue audio content 220 is to be played back using the two near-field transducers 109-110, dialogue audio content 220 may be provided as two channels (e.g., with the same audio content), that is, one for each of the near-field transducers 109-110. The two channels may for example be attenuated by 3 dB to compensate for this duplication of the dialogue audio content 220.

The combined near-field audio content 216 provided as output by the first summing section 215 and the weighted version of the dialogue audio content 220 may be combined (e.g., additively mixed) by a second summing section 224, for example after the respective delays 217 and 222 have been applied. The second summing section 224 may provide two channels, that is, one channel for each of the near-field transducers 109-110, for example by separately combining (or additively mixing) audio content intended for the respective near-field transducers 109-110.

A high pass filter 225 is applied to resulting channels for removing low frequency content which may not be suitable to play back using the near-field transducers 109-110.

The near-field transducers 109-110 may be calibrated 226 (e.g., by a calibration section of an audio processing system) so as to be level aligned with the far-field loudspeakers 101-108, and so that the magnitude of the frequency response of the near-field transducers 109-110 is equalized to match the magnitude of the frequency response of the far-field loudspeakers 101-108 (or to provide a high frequency boost compared to the far-field loudspeakers to improve a perceived proximity effect).

In movie theatres, X-curve equalization may be performed for audio content played back using the far-field loudspeakers 101-108. A boost of high frequency content of the near-field audio content relative to the far-field audio content may for example be provided by applying X-curve equalization to the far-field audio content but not to the audio content played back using the near-field transducers 109-110. Such a high frequency boost may improve a perceived proximity effect of the near-field audio content.

The calibration 226 may be performed using a reference pink noise signal and a microphone (e.g., a calibrated sound level meter; the microphone is also described below with reference to FIG. 5) arranged at the listener position 112 at which the near-field transducers 109-110 are arranged.

Dynamic compression 227 of the near-field audio content may also be performed. If a combined power level of audio content played back using the far-field loudspeakers 101-108 is below a first threshold, the audio content to be played back using the near-field transducers 109-110 may be amplified. If a combined power level of audio content played back using the far-field loudspeakers 101-108 exceeds a second threshold (that is, a threshold above the first threshold), audio content to be played back using the near-field transducers 109-110 may be attenuated.

Near-field audio content to be played back using near-field transducers at the respective listener positions 112, described with reference to FIG. 1, may for example be supplied to distribution amplifiers and may be subjected to B-chain processing. The B-chain settings may for example be fixed (e.g., calibrated by an expert) while users at the respective listener positions 112 may for example have independent control of the near-field dialogue level/volume.

One or more of the channels 201 of the channel-based audio content 201 may include low frequency content. Such a channel 228 including low-frequency content (e.g., a channel intended for playback using the subwoofer 108) may be subjected to low-pass filtering 229 for obtaining only audio content below a frequency threshold. The filtered audio content 230 may be subjected to a gain 231 and an expander/compressor 232 before being fed to the vibratory excitation device 113 for providing haptic/tactile feedback or effects. The expander/compressor 232 may perform dynamic range compression.

The processing steps described with reference to FIG. 2 may be performed by an audio playback system, for example located in a movie theatre, as described below with reference to FIG. 4. Alternatively, one or more of these processing steps may be performed by an audio processing system remote from a movie theatre. For example, the audio playback system 100, described with reference to FIG. 1, may receive near-field audio content prepared by an audio processing system remote from the audio playback system 100 and suitable for near-field playback using the near-field transducers 109-110.

The audio playback system 100 may for example receive a bitstream 114 including both far-field audio content (for playback using the far-field loudspeakers 101-108) and near-field audio content (for playback using the near-field transducers 109-110). The audio playback system 100 may for example comprise a receiving section 115 (e.g., including a demultiplexer) configured to retrieve the far-field audio content and the near-field audio content from the bitstream 114.

The audio playback system 100, described with reference to FIG. 1, may for example receive the extracted audio component 206 and a plurality of audio signals in the form of the channel-based audio content 201. In the present example, the audio playback system 100 system may not receive any object-based audio content 202 (or near-field rendered object-based audio content 212) or any extracted dialogue audio content 220. The audio playback system 100 may play back the plurality of audio signals 201 using the far-field loudspeakers 101-108. The audio playback system 100 may delay 215 the extracted audio component 206 and play it back using the near-field transducers 109-110.

In another example embodiment, the audio playback system 100 may receive the channel-based audio content 201, the object-based audio content 202, the combined near-field audio content 216 provided as output by the first summing section 215 (that is, near-field audio content based on the extracted audio component 206 and the near-field rendered version 212 of the object-based audio content 202), the dialogue audio content 220 (e.g., after the gain 221 has been applied) and low frequency content 230 obtained via low-pas filtering 229. The audio playback system 100 may for example apply delays 217 and 222, summation 224, high pass filtering 225, equalization 226 and/or dynamic compression 227 before playing the near-field audio content using the near-field transducers 109-110. The audio playback system 100 may for example control the vibratory excitation device 113 based on the received low frequency content 230 (e.g., after subjecting it to a gain 231 and an expander/compressor 232).

Figure 3:
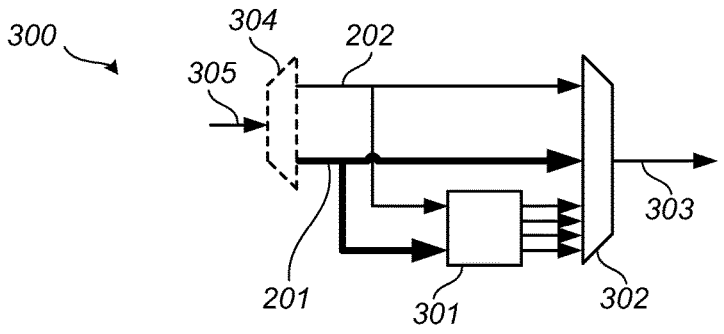
FIG. 3 is a generalized block diagram of an audio processing system, according to an example embodiment.

FIG. 3 is a generalized block diagram of an audio processing system 300, according to an example embodiment. The audio processing system 300 comprises a processing stage 301 and an output stage 302 (e.g., including a multiplexer). The processing stage 301 may be configured to perform one or more of the processing steps described with reference to FIG. 2.

The processing stage 301 receives a plurality of audio signals in the form of the channel-based audio content 201. The received audio signals 201 include the left and right surround channels 206. The processing stage 301 extracts 207 the audio component 208 coinciding with or approximating a component common to the left and right surround channels 206. The plurality of audio signals 201 and the extracted audio component 208 are provided to the output stage 302. The output stage 302 outputs a bitstream 303. The bitstream 303 comprises the plurality of audio signals 201 and at least one additional audio channel comprising the extracted audio component 208.

The bitstream 301 may for example comprise control information (implicit or explicit, for example in the form of metadata) indicating the parts/portions of the bitstream intended for far-field playback and the parts/portions intended for near-field playback.

The processing stage 301 may for example compute near-field audio content based on both channel based audio content 201 and object-based audio content 202, for example received in the Dolby Atmos™ format.

The processing stage 301 may for example compute/derive the audio component 208, the near-field rendered version 212 of the object-based audio content 202, the dialogue audio content 220 and/or the low frequency content 230. The bitstream 303 may for example include the audio component 208, the near-field rendered version 212 of the object-based audio content 202, the dialogue audio content 220 and/or the low frequency content 230, in addition to the channel-based audio content 201 and the object-based audio content 202.

The audio processing system 300 may for example be arranged at an encoder side. The audio processing system 300 may for example have access to the original audio content of a movie before the audio content is mixed and encoded. The audio processing system 300 may for example have access to a dedicated dialogue channel comprising only the dialogue audio content 220, and there may be no need to apply a dialogue extraction algorithm.

The audio processing system 300 may for example be a transcoder which additionally comprises a receiving section 304 (e.g., including a demultiplexer) which receives a bitstream 305 including a plurality of audio signals (e.g., the channel-based audio content 201 and the object-based audio content 202). The receiving section 304 may retrieve the plurality of audio signals from the bitstream 305 and provide these audio signals to the processing section 301.

Figure 4:
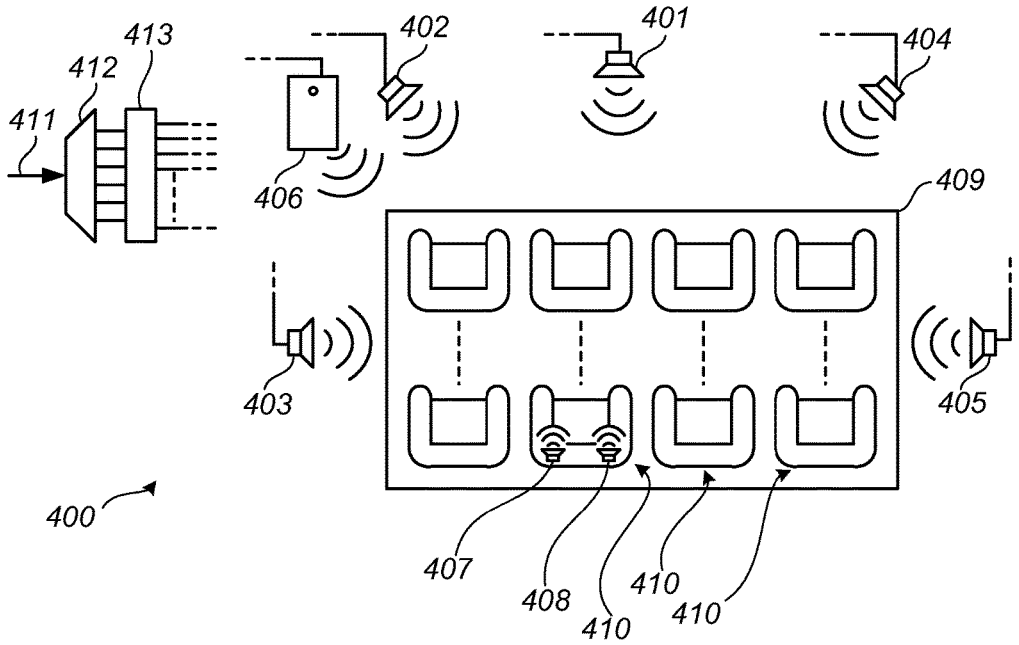
FIG. 4 is a generalized block diagram of an audio playback system, according to an example embodiment.

FIG. 4 is a generalized block diagram of an audio playback system 400, according to an example embodiment. The audio playback system 400 comprises a plurality of far-field loudspeakers 401-406 and a pair of near-field transducers 407-408. The far-field loudspeakers 401-406 are distributed around a space 409 having a plurality of listener positions 410. The plurality of far-field loudspeakers 401-406 includes a pair of far-field loudspeakers 403 and 405 arranged at opposite sides of the space 409 having the plurality of listener positions 410. The near-field transducers 407-408 are arranged at one of the listener positions 410. Similar near-field transducers may for example be arranged at each of the listener positions 410.

The plurality of far-field loudspeakers 401-406 is exemplified herein by a 5.1 speaker setup including center 401 (C), left 402 (L), left surround 403 (Ls), right 404 (R), and right surround 405 (Rs) loudspeakers. The speaker setup also includes a subwoofer 406 for playing back low frequency effects (LFE). In some example settings, such as in movie theaters, the single Ls loudspeaker 403 may for example be replaced by an array of loudspeakers for playing back left surround. Similarly, the single Rs loudspeaker 405 may for example be replaced by an array of loudspeakers for playing back right surround.

The audio playback system 400 receives a bitstream 411 comprising far-field audio content for playback using the far-field loudspeakers 401-406. The audio playback system 400 comprises a receiving section 412 (e.g., including a demultiplexer) configured to retrieve the far-field audio content from the bitstream 411.

In contrast to the audio playback system 100, described with reference to FIG. 1, the audio playback system 400 comprises an audio processing system 413 configured to perform any of the processing steps described with reference to FIG. 2. For example, the audio playback system 400 may receive audio content in the Dolby Atmos™ format (that is, channel-based audio content 201 and object-based audio content 202), and may provide near-field audio content on its own, without assistance of the audio processing system 300, described with reference to FIG. 3.

The audio processing system 413 may be a centralized processing system arranged as a single device or processor. Alternatively, the audio processing system 413 may be a distributed system such as a processing infrastructure. The audio processing system 413 may for example comprise processing sections arranged at the respective listener positions 410.

Figure 5:
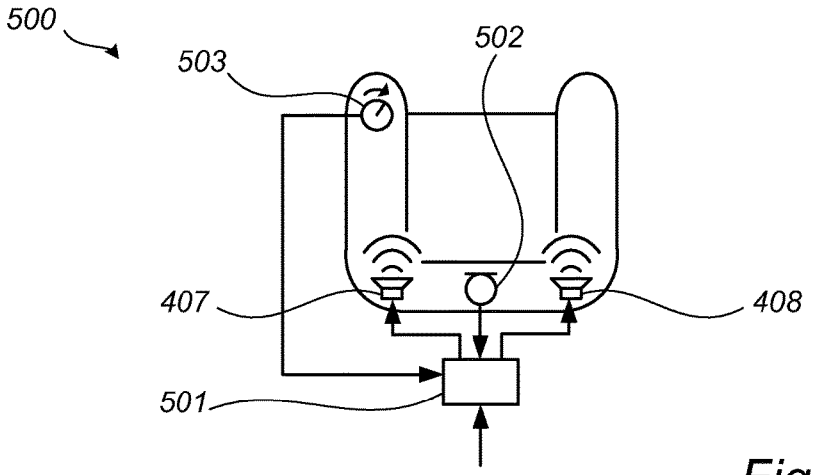
FIG. 5 is a generalized block diagram of an example of a seat arranged at a listener position of the audio playback system described with reference to FIG. 4.

FIG. 5 is a generalized block diagram of a seat 500 arranged at one of the listener positions 410 in the audio playback system 400, described with reference to FIG. 4. In addition to the near-field transducers 407-408, the seat 500 comprises a processing section 501 configured to perform one or more of the processing steps described with reference to FIG. 2, so as to provide near-field audio content for playback using the near-field transducers 407-8 arranged at that listener position 410.

The seat 500 may comprise a microphone 502 (or sound level meter) and an input device 503 (e.g., in the form of a dial, a button and/or a touch screen).

The microphone 502 may be employed for calibrating 226 the near-field transducers 407-408, for example using a reference pink noise signal played back by the near-field transducers 407-408 and/or the far-field loudspeakers 401-406.

The input device 503 may be employed by a user sitting in the seat 500 to indicate that the dialogue level/volume is too low and should be increased. The dialogue level/volume may then be increased by increasing the gain 221 applied to the dialogue audio content 220 prior to playing it back using the near-field transducers 407-408.

Alternatively or additionally, the dialogue level/volume may for example be automatically adjusted (e.g., via the gain 221) relative to the power level of the audio content played back using the far-field loudspeakers 401-406 and/or the near-field transducers 407-408. This automatic adjustment may be performed based on a real-time analysis of the respective power levels, for example by the audio processing system 413 of the audio playback system 400, described with reference to FIG. 4. For example, if the dialogue has originally been mixed into a center channel at a low level relative to other audio content, near-field playback of the dialogue may be performed at a relatively higher level to make the dialogue easier to distinguish from other audio content.

In order to reduce potential leakage of near-field audio content played back by the near-field loudspeakers 407-408 to the other listener positions 410, the near-field playback may automatically be turned off at a listener position when nobody is located at that listener position. This may for example be accomplished by installing sensors (e.g., weight sensors, optical sensors and/or proximity sensors) in the seats of a movie theatre to detect when the sets are unoccupied.

Figure 6:
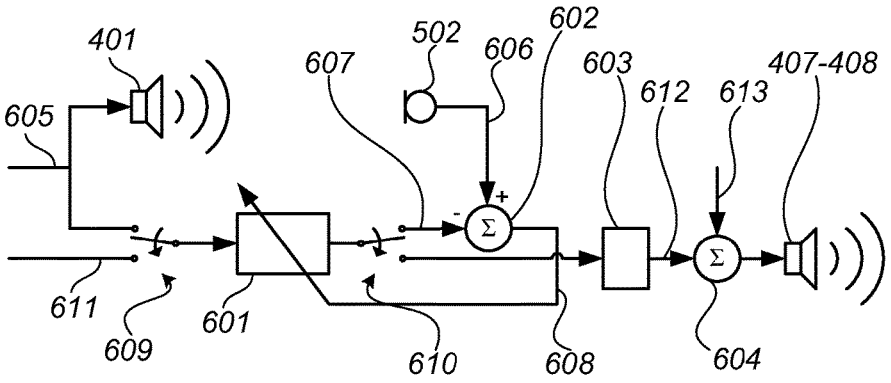
FIG. 6 is a generalized block diagram of an arrangement for dialogue replacement, according to an example embodiment.

FIG. 6 is a generalized block diagram of a dialogue replacement arrangement, according to an example embodiment. The arrangement comprises the center far-field loudspeaker 401 and the near-field transducers 407-408 of the audio playback system 400, described with reference to FIG. 4, the microphone 502, described with reference to FIG. 5, an adaptive filter 601, a difference section 602, an analysis section 603, and a summing section 604. The adaptive filter 601 may be an adaptive filter of a type employed for acoustic echo cancellation, for example a finite impulse response filter (FIR).

In a calibration mode (or learning mode), a test signal 605 is played back using the center far-field loudspeaker 401. The microphone 502 captures the played back test signal 605 at the listener position at which the near-field transducers 407-408 are arranged.

The adaptive filter 601 is adjusted, based on the captured 606 test signal 606, for approximating playback at the center far-field loudspeaker 401 as perceived at the listener position at which the near-field transducers 407-408 are arranged. More specifically, the adaptive filter 601 is applied to the test signal 605 and a residual signal 608 is formed, by the difference section 602, as a difference between the captured test signal 606 and the filtered test signal 607. The adaptive filter 601 is adjusted (or updated) based in the residual signal 608. The adaptive filter 601 may for example be adjusted for decreasing a power and/or energy level of the residual signal 608. If the power level of the residual signal 608 is sufficiently low, this may indicate that the adaptive filter 601 has been appropriately adjusted.

Once the adaptive filter 601 has been appropriately adjusted, it may be employed for estimating/approximating playback by the center far-field loudspeaker 401 as perceived at the listener position at which the near-field transducers 407-408 are arranged. The dialogue replacement arrangement is then switched to a replacement mode (or active mode) by operating two switches 609 and 610 from their respective uppermost positions to their respective lowermost positions.

Assume that the plurality of audio signals received by the audio playback system 400 includes a center channel played back using the center far-field loudspeaker 401, and that the center channel comprises first dialogue audio content 611. The first dialogue audio content 611 may be extracted by applying a dialogue extraction algorithm to the center channel. In the replacement mode, the adaptive filter 601 is applied to the extracted first dialogue audio content 611, and the analysis section 603 receives the filtered first dialogue audio content. The analysis section 603 generates second dialogue audio content 612 based on the filtered first audio content. The second dialogue audio content 612 is then played back using the near-field transducers 407-408 for cancelling, at the listener position at which the near-field transducers are arranged, the first dialogue audio content 611 played back (as part of the center channel) using the center far-field loudspeaker 401.

As the first dialogue audio content 611 is cancelled at the listener position at which the near-field transducers 407-408 are arranged, alternative dialogue audio content may be provided to replace it. Third dialogue audio content 613 may therefore be played back using the near-field transducers 407-408 in addition to the second dialogue audio content 612. The third dialogue audio content 612 may for example be combined (or additively mixed) with the second dialogue audio content 612 in the summing section 604.

The first dialogue audio content 611 may for example be an English dialogue, while the third dialogue audio content 613 is a corresponding dialogue in Spanish. In the replacement mode, the dialogue arrangement serves to replace the English dialogue by the Spanish dialogue at the listener position at which the near-field transducers 407-408 are arranged.

Figure 7:
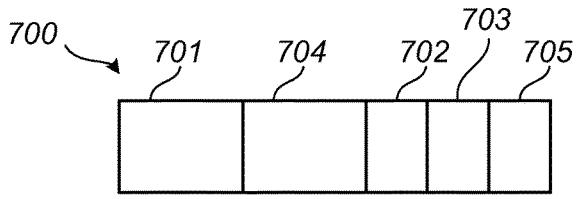
FIG. 7 is a schematic overview of data stored on (or conveyed by) a computer-readable medium, in accordance with a bitstream format provided by the audio processing system described with reference to FIG. 3.

FIG. 7 is a schematic overview of data 700 stored on (or conveyed by) a computer-readable medium, in accordance with a bitstream format provided by the audio processing system 300, described with reference to FIG. 3. The computer-readable medium stores (or conveys) data representing a plurality of audio signals 701 and at least one additional audio channel 702.

In the present example embodiment, the plurality of audio signals 701 is the channel-based audio content 201, described with reference to FIG. 2. The plurality of audio signals 701 includes the left and right surround channels 206. The at least one additional audio channel 702 comprises the audio component 208, described with reference to FIG. 2, coinciding with or approximating audio content common to the left and right surround channels 206. The data enables joint playback by the far-field loudspeakers 101-108 and the near-field transducers 109-110, described with reference to FIG. 1, wherein a sound field is reconstructed by way of the playback.

The computer-readable medium may for example store (or convey) data representing dialogue audio content 703, for example a dialogue audio channel including the dialogue audio content 220, described with reference to FIG. 2.

The computer-readable medium may for example store (or convey) data representing at least one object-based audio signal 704 (e.g., the object-based audio content 202, described with reference to FIG. 2) and a near-field rendered version of the object-based audio signal 704 (e.g., the near-field rendered version 212 of the object-based audio content 202, described with reference to FIG. 2). The near-field rendered version of the object-based audio signal 704 may for example be stored using two channels 702 also comprising the audio component 208. The two channels 702 may for example be linear combinations of the extracted component 208 and the near-field rendered version 212 of the object-based audio content 202.

The computer-readable medium may for example store (or convey) data representing low frequency audio content (e.g., the low frequency content 230, described with reference to FIG. 2).

The computer-readable medium may for example store (or convey) data 700 representing any of the signals described with reference to FIG. 2.

The computer-readable medium may for example store (or convey) control information indicating parts/portions of the data intended for near-field playback and far-field playback, respectively. The control information may for example indicate where the respective portions 701, 702, 703, 704 and 705 of the data 700 may be retrieved.

Figure 8:
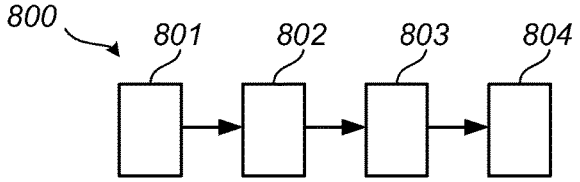
FIG. 8 is a flow chart of an audio playback method, according to an example embodiment.

FIG. 8 is a flow chart of an audio playback method 800, according to an example embodiment. The playback method 800 may for example be performed by any of the audio playback systems 100 and 400, described with reference to FIGS. 1 and 4. The playback method 800 comprises receiving 801 a plurality of audio signals including a left surround channel and a right surround channel, playing back 802 the audio signals using a plurality of far-field loudspeakers distributed around a space having a plurality of listener positions, wherein the left and right surround channels are played back by a pair of far-field loudspeakers arranged at opposite sides of the space having the plurality of listener positions, obtaining 803 an audio component coinciding with or approximating audio content common to the left and right surround channels, and playing back 804 the audio component at least using a pair of near-field transducers arranged at one of the listener positions.

Figure 9:
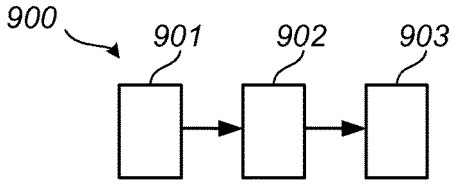
FIG. 9 is a flow chart of an audio processing method, according to an example embodiment.

FIG. 9 is a flow chart of an audio processing method 900, according to an example embodiment. The processing method 900 may for example be performed by the audio processing system 300, described with reference to FIG. 3. The processing method 900 comprises receiving 901 a plurality of audio signals including a left surround channel and a right surround channel, extracting 902 an audio component coinciding with or approximating audio content common to the left and right surround channels, and providing 903 a bitstream, the bitstream comprising the plurality of audio signals and at least one additional audio channel comprising the audio component.

It will be appreciated that the 5.1 and 7.1 far-field speaker setups described with reference to FIGS. 1 and 4 serve as examples, and that audio playback systems according to example embodiments may employ other arrangements of far-field loudspeakers, for example including ceiling-mounted loudspeakers.

V. EQUIVALENTS, EXTENSIONS, ALTERNATIVES AND MISCELLANEOUS

Even though the present disclosure describes and depicts specific example embodiments, the invention is not restricted to these specific examples. Modifications and variations to the above example embodiments can be made without departing from the scope of the invention, which is defined by the accompanying claims only.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs appearing in the claims are not to be understood as limiting their scope.

The devices and methods disclosed above may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out in a distributed fashion, by several physical components in cooperation. Certain components or all components may be implemented as software executed by a digital processor, signal processor or microprocessor, or be implemented as hardware or as an application-specific integrated circuit. Such software may be distributed on computer readable media, which may comprise computer storage media (or non-transitory media), and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

The invention claimed is:

1. An audio playback method comprising:

receiving a plurality of audio signals including a left surround channel and a right surround channel;

playing back the audio signals using a plurality of far-field loudspeakers distributed around a space having a plurality of listener positions, wherein the left and right surround channels are played back by a pair of far-field loudspeakers arranged at opposite sides of the space having the plurality of listener positions;

obtaining an audio component coinciding with or approximating audio content common to the left and right surround channels; and playing back the audio component at least using a pair of near-field transducers arranged at one of the listener positions.

2. The method of claim 1, wherein the audio component is obtained by receiving the audio component in addition to the plurality of audio signals.

3. The method of claim 1, wherein the audio component is obtained by extracting the audio component from the left and right surround channels.

4. The method of claim 1, further comprising:

estimating a propagation time from the pair of far-field loudspeakers to the listener position at which the near-field transducers are arranged; and determining, based on the estimated propagation time, a delay to be applied to the playback of the audio component using the near-field transducers.

5. The method of claim 1, further comprising:

high pass filtering audio content to be played back using the near-field transducers.

6. The method of claim 1, further comprising:

obtaining dialogue audio content associated with at least one of the received audio signals; and playing back the dialogue audio content using one or more near-field transducers arranged at a listener position.

7. The method of claim 6, wherein the dialogue audio content is obtained by receiving the dialogue audio content in addition to the plurality of audio signals.

8. The method of claim 7, wherein the dialogue audio content is obtained by applying a dialogue extraction algorithm to at least one of the received audio signals.

9. The method of claim 6, wherein the dialogue audio content is associated with an audio signal played back by a center far-field loudspeaker, the method further comprising:

estimating a propagation time from the center far-field loudspeaker to the listener position at which the one or more near-field transducers are arranged; and determining, based on the estimated propagation time, a delay to be applied to the playback of the dialogue audio content using the one or more near-field transducers.

10. The method of claim 9, comprising:

applying a gain to the dialogue audio content prior to playing it back using the one or more near-field transducers; and subsequently increasing the gain in response to input from a user.

11. The method of claim 10, wherein the gain is frequency-dependent, wherein the gain is increased more for a first frequency range than for a second frequency range, and wherein the first frequency range comprises higher frequencies than the second frequency range.

12. The method of claim 6, comprising:

estimating a power ratio between the dialogue audio content and audio content played back using the far-field loudspeakers or audio content played back using the pair of near-field transducers or a combination of audio content played back using the far-field loudspeakers and audio content played back using the pair of near-field transducers; and adjusting, based on the estimated power ratio, a gain applied to the dialogue audio content prior to playing it back using the one or more near-field transducers.

13. The method of claim 1, wherein the received plurality of audio signals includes a channel comprising first dialogue audio content, and wherein said channel is played back using a far-field loudspeaker, the method comprising:

playing back an audio signal using said far-field loudspeaker;

capturing the played back audio signal at the listener position at which the one or more near-field transducers are arranged; and adjusting, based on the captured audio signal, an adaptive filter for approximating playback at said far-field loudspeaker as perceived at the listener position at which the one or more near-field transducers are arranged;

obtaining the first dialogue audio content by applying a dialogue extraction algorithm to said channel or by receiving the first dialogue audio content in addition to the received plurality of audio signals;

applying the adaptive filter to the obtained first dialogue audio content;

generating second dialogue audio content based on the filtered first dialogue audio content; and playing back the second dialogue audio content using the one or more near-field transducers for at least partially cancelling, at the listener position at which the one or more near-field transducers are arranged, the first dialogue audio content played back using said far-field loudspeaker.

14. The method of claim 13, further comprising:

playing back third dialogue audio content using the one or more near-field transducers.

15. The method of claim 6, comprising:

forming a linear combination of at least the audio component and the dialogue audio content; and playing back the linear combination using the pair of near-field transducers.

16. The method of claim 1, further comprising:

receiving an object-based audio signal;

rendering the object-based audio signal with respect to one or more of the far-field loudspeakers;

playing back the rendered object-based audio signal using the one or more far-field loudspeakers;

obtaining a near-field rendered version of the object-based audio signal; and playing back the near-field rendered version of the object-based audio signal using the pair of near-field transducers.

17. The method of claim 16, wherein the near-field rendered version of the object-based audio signal is obtained by receiving the near-field rendered version of the object-based audio signal.

18. The method of claim 16, wherein the near-field rendered version of the object-based audio signal is obtained by rendering the object-based audio signal with respect to the pair of near-field transducers.

19. The method of claim 16, comprising:

estimating a propagation time from the one or more far-field loudspeakers to the listener position at which the pair of near-field transducers is arranged; and determining, based on the estimated propagation time, a delay to be applied to the playback of the near-field rendered version of the object-based audio signal using the pair of near-field transducers.

20. The method of claim 1, comprising, for a given listener position:

playing back a test signal using a far-field loudspeaker and/or a near-field transducer arranged at the listener position;

measuring a power level of the played back test signal at the listener position; and calibrating an output level of the near-field transducer relative to an output level of one or more far-field loudspeakers based on the measured power level.

21. The method of claim 1, comprising, for a given listener position:

playing back a test signal using a far-field loudspeaker and/or a near-field transducer arranged at the listener position;

capturing the played back test signal at the listener position; and calibrating a frequency response of the near-field transducer relative to a frequency response of one or more far-field loudspeakers based on the captured test signal.

22. The method of claim 21, wherein a ratio between a magnitude of the frequency response of the near-field transducer and a magnitude of the frequency response of the one or more far-field loudspeakers is calibrated to be higher for a first frequency range than for a second frequency range, wherein the first frequency range comprises higher frequencies than the second frequency range.

23. The method of claim 1, comprising:

in response to a combined power level of audio content played back using the far-field loudspeakers being below a first threshold, amplifying audio content to be played back using the pair of near-field transducers; and/or in response to a combined power level of audio content played back using the far-field loudspeakers exceeding a second threshold, attenuating audio content to be played back using the pair of near-field transducers.

24. The method of claim 1, comprising:

obtaining, based on at least one of the received audio signals, audio content below a frequency threshold; and feeding the obtained audio content to a vibratory excitation device mechanically coupled to a part of a seat located at the listener position at which the pair of near-field transducers is arranged.

25. A computer program product comprising a non-transitory computer-readable medium with instructions for causing a computer to perform the method of claim 1.

26. An audio playback system comprising:

a plurality of far-field loudspeakers distributed around a space having a plurality of listener positions, the plurality of loudspeakers including a pair of far-field loudspeakers arranged at opposite sides of the space having the plurality of listener positions; and a pair of near-field transducers arranged at one of the listener positions;

wherein the audio playback system is configured to:

receive a plurality of audio signals including a left surround channel and a right surround channel;

play back the audio signals using the far-field loudspeakers, wherein the left and right surround channels are played back using said pair of far-field loudspeakers;

obtain an audio component coinciding with or approximating audio content common to the left and right surround channels; and play back the audio component using the near-field transducers.

* * * * *